US011530113B2

(12) United States Patent
Rosenthal

(10) Patent No.: US 11,530,113 B2
(45) Date of Patent: Dec. 20, 2022

(54) DRIVE SHAFT FOR AN ELEVATOR SYSTEM

(71) Applicant: thyssenkrupp Elevator Innovation and Operations GmbH, Essen (DE)

(72) Inventor: Jakub Rosenthal, Esslingen (DE)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 243 days.

(21) Appl. No.: 16/604,407

(22) PCT Filed: Mar. 29, 2018

(86) PCT No.: PCT/EP2018/058226
§ 371 (c)(1),
(2) Date: Oct. 10, 2019

(87) PCT Pub. No.: WO2018/188974
PCT Pub. Date: Oct. 18, 2018

(65) Prior Publication Data

US 2020/0180913 A1 Jun. 11, 2020

(30) Foreign Application Priority Data

Apr. 10, 2017 (DE) ..... 10 2017 206 131.6

(51) Int. Cl.
*B66B 11/08* (2006.01)
*B66B 15/04* (2006.01)

(52) U.S. Cl.
CPC ..... *B66B 11/08* (2013.01); *B66B 15/04* (2013.01)

(58) Field of Classification Search
CPC ..... B66B 15/04; B66B 11/08
See application file for complete search history.

(56) References Cited

U.S. PATENT DOCUMENTS

| | | | |
|---|---|---|---|
| 8,348,019 | B2 | 1/2013 | Blochle |
| 2003/0040386 | A1 | 2/2003 | Yamasaki |
| 2007/0056804 | A1 | 3/2007 | Thielow |

(Continued)

FOREIGN PATENT DOCUMENTS

| | | | |
|---|---|---|---|
| CN | 1419519 | A | 5/2003 |
| CN | 1886324 | A | 12/2006 |

(Continued)

OTHER PUBLICATIONS

Machine Translation of CN 103527748 Jan. 2014.*

(Continued)

*Primary Examiner* — Diem M Tran
(74) *Attorney, Agent, or Firm* — William J. Cassin

(57) ABSTRACT

A drive shaft for an elevator system, includes a support shaft and a traction sheave with at least one traction face for driving a traction mechanism, for example a drive belt, of the elevator system. A connection is provided for the transmission of a drive torque from the support shaft to the traction sheave, the traction sheave being of separate configuration from the support shaft. The traction sheave is held with an inner guide face on an outer guide face of the support shaft. The connection includes at least one axially projecting traction sheave-side circumferential stop which is in positively locking engagement with a support shaft-side circumferential stop.

14 Claims, 2 Drawing Sheets

(56) References Cited

U.S. PATENT DOCUMENTS

| | | | | |
|---|---|---|---|---|
| 2009/0001333 | A1* | 1/2009 | Blochle | B66B 15/04 254/390 |
| 2013/0056305 | A1 | 3/2013 | Sanchez et al. | |
| 2014/0245984 | A1 | 9/2014 | Seillier et al. | |
| 2014/0290871 | A1 | 10/2014 | Muto | |
| 2016/0083223 | A1 | 3/2016 | Altenburger | |
| 2020/0262684 | A1 | 8/2020 | Liu | |

FOREIGN PATENT DOCUMENTS

| | | | | | |
|---|---|---|---|---|---|
| CN | 103053238 | A | | 4/2013 | |
| CN | 202881698 | U | | 4/2013 | |
| CN | 103527748 | A | * | 1/2014 | |
| CN | 103527748 | A | | 1/2014 | |
| CN | 204490289 | U | | 7/2015 | |
| CN | 105293334 | A | | 2/2016 | |
| CN | 105438924 | A | | 3/2016 | |
| CN | 205241011 | U | | 5/2016 | |
| CN | 205241011 | U | * | 5/2016 | B66B 11/08 |
| DE | 33 30 330 | A | | 3/1985 | |
| DE | 3330330 | A1 | | 3/1985 | |
| DE | 19536057 | C1 | * | 6/1997 | F16D 1/072 |
| DE | 196 16 232 | A | | 10/1997 | |
| DE | 19616232 | A1 | | 10/1997 | |
| DE | 102007039238 | A1 | | 2/2009 | |
| DE | 10 2014 208 946 | A | | 11/2015 | |
| DE | 102015103921 | A1 | | 9/2016 | |
| EP | 1566358 | A | | 8/2005 | |
| EP | 1886795 | A1 | | 2/2008 | |
| EP | 1886958 | A1 | | 2/2008 | |
| EP | 2 574 584 | A | | 4/2013 | |
| JP | H11141538 | A | | 5/1999 | |
| JP | 2016 003713 | A | | 1/2016 | |

OTHER PUBLICATIONS

English Translation of International Search Report issued in PCT/EP2018/058226, dated May 9, 2018.

First Office Action, dated Apr. 13, 2021, in Chinese counterpart application No. 201880024317.5, citing the above identified references that have not previously been listed in a prior filed IDS.

Second Office Action, dated Nov. 18, 2021, in Chinese counterpart application No. 201880024317.5, citing the above identified references that have not previously been listed in a prior filed IDS.

Notice of Allowance, dated Apr. 28, 2022, in Chinese counterpart application No. 201880024317.5, citing the above identified references that have not previously been listed in a prior filed IDS in this pending application.

* cited by examiner

DRIVE SHAFT FOR AN ELEVATOR SYSTEM

CROSS REFERENCE TO RELATED APPLICATIONS

This application is a U.S. National Stage Entry of International Patent Application Serial Number PCT/EP2018/058226, filed Mar. 29, 2018, which claims priority to German Patent Application No. DE 10 2017 206 131.6, filed Apr. 10, 2017, the entire contents of both of which are incorporated herein by reference.

FIELD

The present disclosure generally relates to a drive shaft for an elevator system.

BACKGROUND

EP 2 574 584 A1 discloses an elevator system, in the case of which a car is driven by supporting means in the form of drive belts. A drive having a motor and a drive shaft drives the car.

The drive shaft comprises a support shaft and a traction sheave, and can be of single-piece or multiple-piece configuration with the traction sheave. If the support shaft is of separate configuration from the traction sheave, a non-rotational (for example, positively locking) connection is to be provided between them. In the case of a classic tongue/groove connection, the strength of one of the connecting partners is weakened here by way of the groove, in order to provide a drive face. In the case of belt drives, however, components which are as small as possible are required; further weakening by way of a groove can then no longer be accepted.

Thus a need exists for an improved drive arrangement.

DETAILED DESCRIPTION

Figure 1:
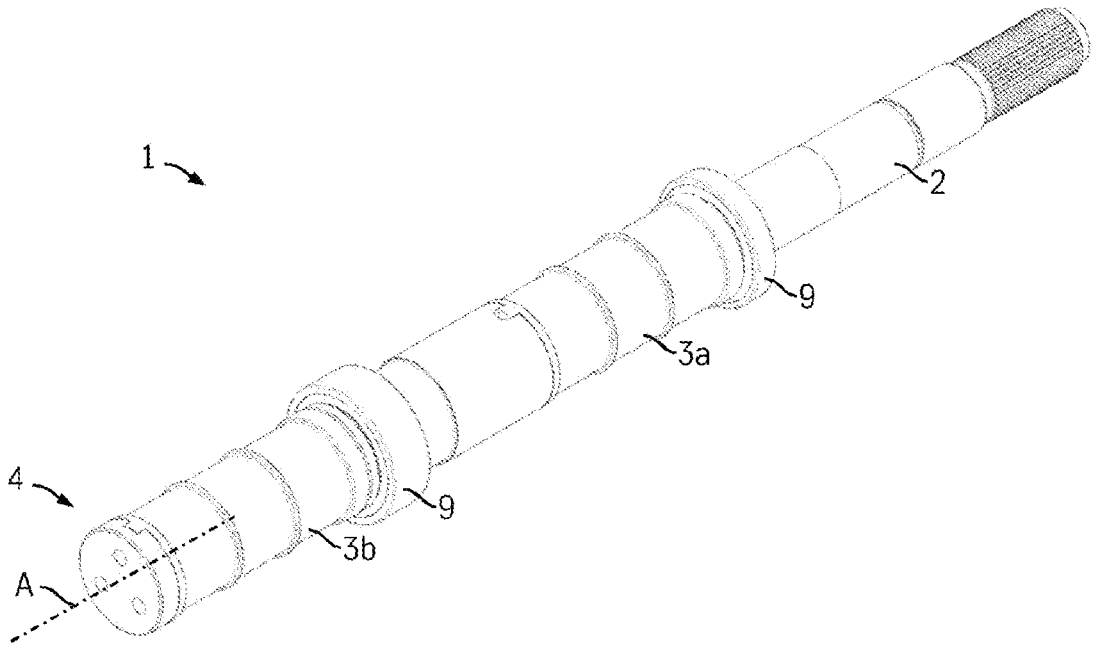
FIG. 1 is a perspective view of a drive shaft.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims.

In addition, all references to one skilled in the art shall be understood to refer to one having ordinary skill in the art.

The drive shaft according to the invention for an elevator system comprises

- a support shaft,
- a traction sheave with at least one traction face for driving a traction mechanism, in particular a drive belt, of the elevator system,
- a connection for the transmission of a drive torque from the support shaft to the traction sheave, the traction sheave being of separate configuration from the support shaft, the traction sheave being held with an inner guide face on an outer guide face of the support shaft.

The connection comprises at least one axially projecting traction sheave-side circumferential stop which is in positively locking engagement with a support shaft-side circumferential stop.

The use of a radially projecting stop can be dispensed with as a result of the use of an axially projecting stop. This enables a utilization of the radial installation space which is as efficient as possible, which is advantageous, in particular, in the case of drive shafts with very small diameters.

The centroid of the traction sheave is preferably arranged concentrically with respect to the one rotational axis. In particular, all of the traction sheave-side circumferential stops of a traction sheave are arranged in such a way that the common centroid thereof is arranged on the rotational axis. The avoidance of unbalances is significant, in particular, in the case of comparatively small traction sheaves, since the rotational speeds of the traction sheave are very high.

In one refinement, the support shaft-side circumferential stop protrudes radially beyond the outer guide face.

In one refinement, the traction sheave-side circumferential stop is arranged on an end side of the traction sheave. A radial cutout on the traction sheave is therefore obsolete.

In one refinement, the support shaft-side circumferential stop is arranged on a connecting piece which is of separate configuration from the support shaft. Difficulties during the assembly can be avoided by way of the separate configuration.

In a further refinement, the support shaft-side circumferential stop is configured in one piece with the support shaft.

The inner guide face can have exclusively circular cross sections over its axial length, and/or the outer guide face can have exclusively circular cross sections over its axial length. As a result of the exclusively circular cross section, the face is in each case free of grooves or other weakened points.

The inner guide face and/or the outer guide face can be of cylindrical or conical configuration, in particular can be of completely cylindrical or completely conical configuration.

The traction sheave-side circumferential stop is at a spacing from the drive axis, which spacing is not smaller than 0.3 times or 0.5 times the diameter of an outer guide face of the support shaft, on which the traction sheave is guided axially in the region of the traction face.

The elevator system according to the invention comprises a drive shaft of the abovementioned type.

Furthermore, the elevator system can comprise a supporting means, the supporting means having a radial supporting means diameter, the traction face having a traction face diameter, a ratio T/d of the traction face diameter and the radial supporting means diameter being at most 40.

The traction sheave is of sleeve-like configuration; this means that a maximum radial wall thickness of the traction face is at most 0.3 times the axial extent of a traction face.

The wall thickness can be of considerably greater configuration in the region of circumferential webs between the traction faces.

A braking torque can also be transmitted via the drive shaft.

The traction face can fundamentally have a slightly convex curvature. Here, a variance of the radial traction face diameter of a few millimeters can result along the traction face, which variance is negligible in the present case, however.

The traction face of the traction sheave has, in particular, a diameter T of at most 20 cm. In the case of traction sheaves which are this small, the advantages of the invention particularly come into their own, since the conflict between a small component size and great mechanical loading is very high here.

The traction sheave is arranged, in particular, coaxially with respect to the support shaft.

The ratio W/L of the wall thickness of the traction sheave and the axial extent L of the traction face is, in particular, at most 0.5, further preferably at most 0.3. In this respect, a sleeve-like structure of the traction sheave arises as a result.

Here, the outer guide face is understood to mean that axial region of the outer contour of the traction sheave which overlaps the traction faces axially. Other regions of the outer contour which are axially outside said axial overlap are not called an outer guide face.

A circumferential stop is an element which can provide a positively locking drive connection which acts in the circumferential direction with respect to a circumferential stop of another component.

In principle, one or more traction sheaves can be arranged on a support shaft.

Figure 2:
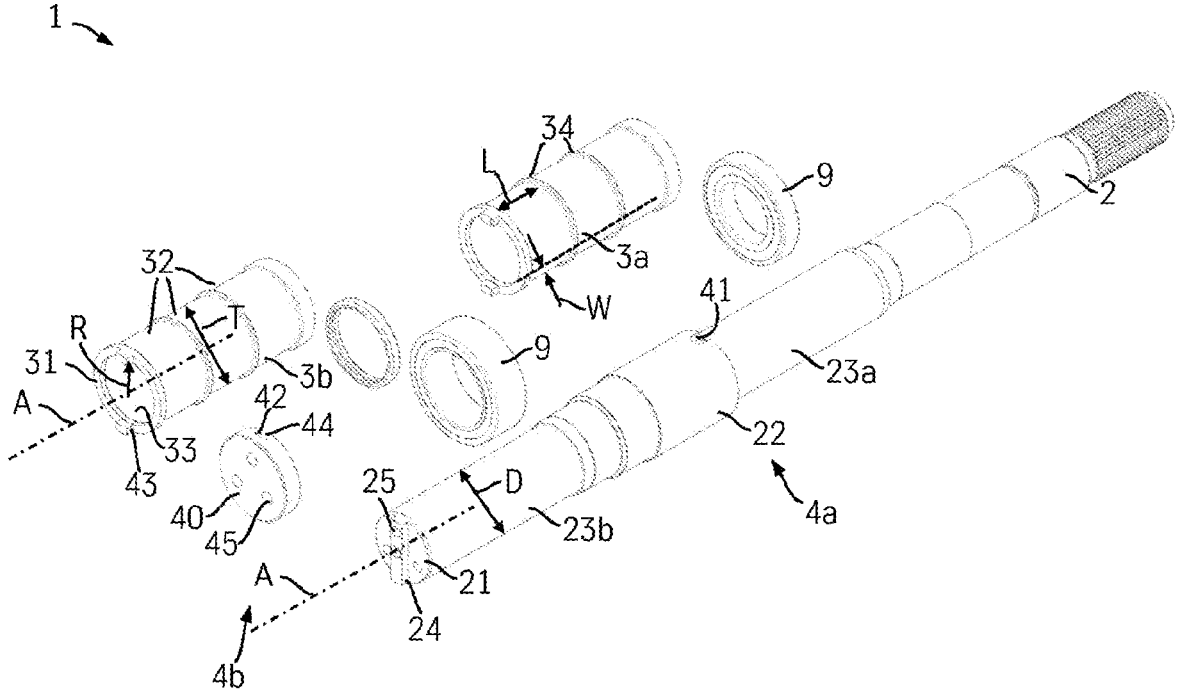
FIG. 2 is an exploded view of the drive shaft according to FIG. 1.
Figure 3:
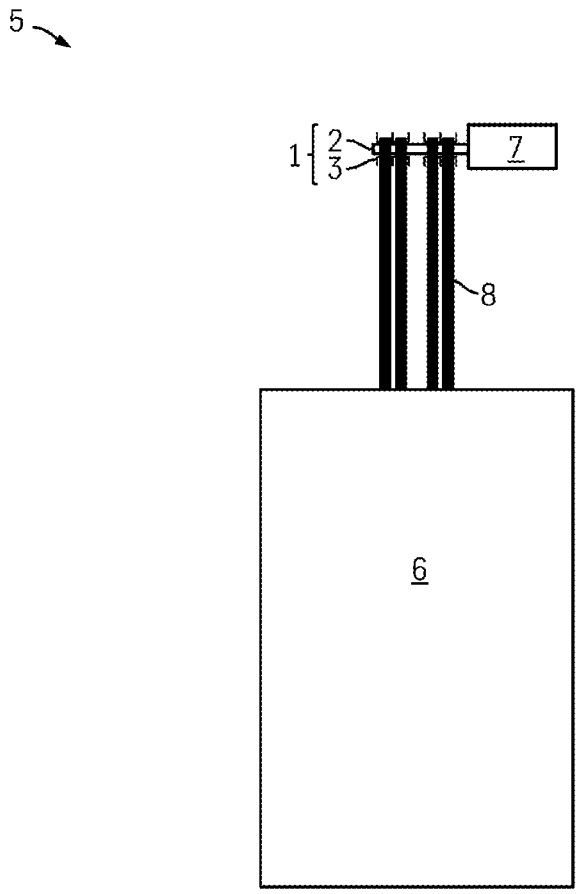
FIG. 3 is a view of an elevator system with a drive shaft according to FIG. 1.

FIG. 3 shows an elevator system 5 according to the invention. The elevator system 5 comprises a car 6 which can be moved by means of a drive motor 7. The car 6 is held on a drive shaft 1 according to the invention by traction mechanisms in the form of drive belts 8. In said figure, four drive belts 8 are illustrated; the precise number of drive belts 8 is not important, however. The drive shaft 1 is connected to a drive motor 7. The drive shaft 1 will be described in greater detail on the basis of FIGS. 1 and 2. Belt drives of this type make the use of comparatively small traction sheaves possible, which in turn makes the use of comparatively small motors possible. Small shaft diameters of the drive shaft are therefore also required, however, which leads to high requirements with regard to their strength. This is because, in addition to the transmission of the drive torque, the drive shaft also has to support large parts, inter alia, of the weight of the car 6, the supporting means 8 and the counterweight (not shown).

FIGS. 1 and 2 will be described jointly in the following text. The drive shaft 1 according to the invention comprises a support shaft 2 which is connected to the drive motor via a connection which is described in greater detail. Two traction sheaves 3*a*, 3*b* are arranged on the support shaft 2, which traction sheaves 3*a*, 3*b* are separated spatially from one another by way of a bearing 9. The first traction sheave 3*a* is arranged on a first outer guide face 23*a*. A second traction sheave 3*b* is arranged on a second outer guide face. The first traction sheave 3*a* is arranged on a first outer guide face 23*a*. A second traction sheave 3*b* is arranged on a second outer guide face. In the present case, the traction sheaves 3*a*, 3*b* are of identical configuration with respect to one another, with the result that only the traction sheave 3 will be described in the further description.

The traction sheave 3 comprises three traction faces 32 which are separated from one another by way of circumferential webs 34. Precisely one drive belt 8 (FIG. 3) is guided on each traction face 32. The traction sheave 3 is of sleeve-like configuration; that means that a maximum radial wall thickness W of the traction face 32 is at most 0.5 times the axial extent L of a traction face 32. The wall thickness can be of considerably greater configuration in the region of the circumferential webs.

In order for it to be possible for both the support shaft 2 and the traction sheave 3 to be of as small and nevertheless as stable construction as possible, both the inner guide face 33 of the traction sheave and the outer guide face 23 of the support shaft 2 are of completely cylindrical configuration, in particular, in the highly loaded axial region of the traction faces 32. This means that the inner guide face has no deviation from the circular shape in all cross sections along the rotational axis A, which might otherwise bring about weakening of the strength.

In the case of known drive shafts of this type, the drive torque for an axial tongue and groove connection is formed radially between the guide faces, which brings about, however, the addressed weakening in the case of the support shaft and/or the traction sheave, depending on where a groove is provided.

According to the invention, provision is then mad for the torque to be introduced via in each case a traction sheave-side circumferential stop 43, which protrudes axially from an end side 31 of the traction sheave 3. Said traction sheave-side circumferential stop 43 is in engagement with a first or second support shaft-side circumferential stop 41, 42 which is driven by way of the support shaft.

Here, the invention provides two possible configurations. The first connection 4*a* of the first traction sheave 3*a* to the support shaft 2 comprises a radial support shaft projection 22. The corresponding first support shaft-side circumferential stop 41 is arranged on said support shaft projection 22. The support shaft projection 22 is connected fixedly to the support shaft 2 so as to rotate with it, and is configured, in particular, in one piece with the support shaft 2. In this case, the support shaft-side circumferential stop 41 is arranged in a groove. The traction sheave-side circumferential stop 43 is formed by way of an axial projection.

The second connection 4*b* of the second traction sheave 3*b* to the support shaft 2 has a connecting piece 40 which is fastened fixedly to an end side 21 of the support shaft 2 so as to rotate with it. Said connecting piece 40 protrudes beyond the end side 21 of the support shaft 2 in the radial direction. The second support shaft-side circumferential stop 42 is then arranged on said connecting piece 40. In this case, the support shaft-side circumferential stop 42 is also arranged in a connecting groove 44, and the traction sheave-side circumferential stop 43 is formed by way of the axial projection.

The connecting groove 44 also serves at the same time for connecting the connecting piece 40 to the support shaft 2 fixedly so as to rotate with it. For this purpose, the end side 21 of the support shaft 2 has a connecting tongue 24 which is of complementary configuration with respect to the connecting groove 44. For the fixed connection, the connecting piece 40 is screwed on the end side 21. To this end, the connecting piece 40 and the support shaft 2 in each case have fastening bores 45, 25 which are oriented with respect to one another on the end side 21.

The advantage then lies in the fact that a positively locking means in the form of a recess (for example, a groove) does not have to be provided either on the inner guide face 33 or on the outer guide face 23, which positively locking means might weaken the component. The support shaft and the traction sheave 3 can therefore be optimized completely for as low a weight as possible and as small a size as possible.

In the present exemplary embodiment, the guide faces 23, 33 are of cylindrical configuration. As an alternative, it is also possible that they are of conical configuration or are configured as a combination consisting of cylindrical and conical faces. Both the completely cylindrical shape and also the completely conical shape can be produced simply by way of turning, and always have a circular cross section along the rotational axis A.

Figure 4:
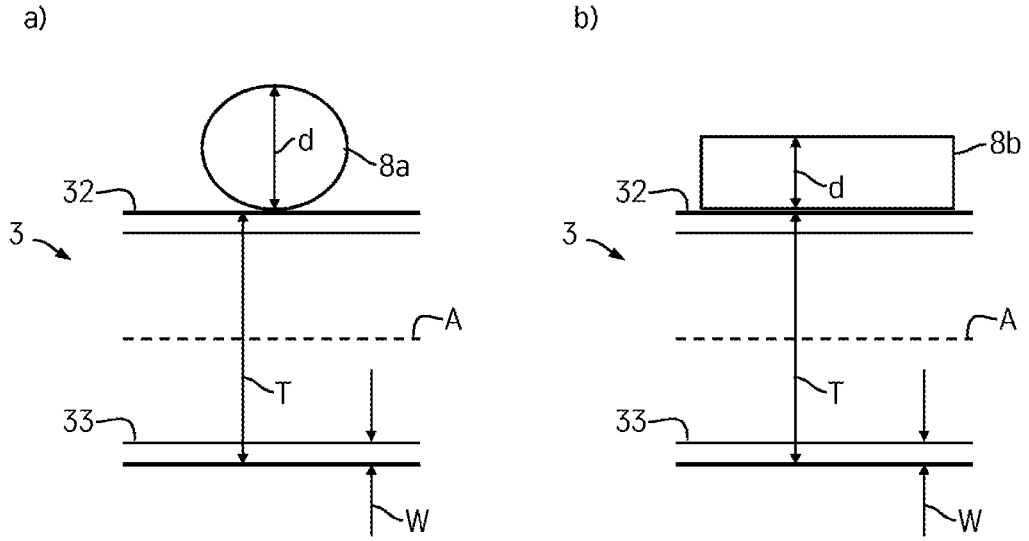
FIG. 4A is a sectional view along the rotational axis through suitable supporting means and traction sheaves.
FIG. 4B is a sectional view along the rotational axis through suitable supporting means and traction sheaves.

In a self-explanatory manner, FIG. 4 illustrates the claimed ratio of T/d of the traction face diameter T and the radial supporting means diameter d, which ratio is at most 40.

LIST OF DESIGNATIONS

1 Drive shaft
2 Support shaft
3 Traction sheave
4 Positively locking connection
5 Elevator system
6 Car
7 Drive motor
8 Supporting means
8*a* Drive cable
8*b* Drive belt
9 Bearing
21 End side of the support shaft
22 Radial support shaft projection
23 Outer guide face
24 Connecting tongue
25 Fastening bore
31 End side of the traction sheave
32 Traction face
33 Inner guide face
34 Circumferential web
40 Connecting piece
41 Support shaft-side circumferential stop on the support shaft projection
42 Support shaft-side circumferential stop on the connecting piece
43 Traction sheave-side circumferential stop
44 Connecting groove
45 Fastening bore
A Rotational axis
L Axial length of the traction face
W Wall thickness of the traction sheave on the traction face
D Diameter of the outer guide face
T Diameter of the traction face
d Radial diameter of the drive means

What is claimed is:

1. A drive shaft for an elevator system, comprising:
a support shaft having an outer guide face;
at least one support shaft-side circumferential stop, defined in or extending from an axially-directed face of said support shaft, that is configured to impart a circumferentially directed rotational drive force during axial rotational movement of said support shaft;
a traction sheave having an inner guide face, and a traction face configured to drive a traction mechanism of the elevator system, said traction sheave being concentrically disposed on said support shaft about a central axis such that said inner guide face of said traction sheave is positioned against said outer guide face of said support shaft; and
at least one traction sheave-side circumferential stop extending from or defined in an axially-directed face of said traction sheave in an axial direction of the central axis, and disposed in a complementary positive locking engagement with said at least one support shaft-side circumferential stop, such that a circumferentially-directed side face of said at least one traction sheave-side circumferential stop constantly abuts a complimentary circumferentially-directed side face of said at least one support shaft-side circumferential stop, so as to enable said support shaft to transmit a drive torque from said support shaft to said traction sheave via said abutting side faces of said circumferential stops,
wherein a ratio W/L of a wall thickness W of said traction sheave and an axial length L of said traction face is at most 0.5.

2. The drive shaft of claim 1 wherein the traction mechanism includes a drive belt.

3. The drive shaft of claim 1 wherein the traction sheave includes a centroid arranged concentrically with respect to a rotational axis thereof.

4. The drive shaft of claim 3 wherein the traction sheave comprises more than one traction sheave-side circumferential stop and every traction sheave-side circumferential stop is arranged with a common centroid on the rotational axis.

5. The drive shaft of claim 1 wherein the support shaft-side circumferential stop protrudes radially beyond the outer guide face.

6. The drive shaft of claim 1 wherein the traction sheave-side circumferential stop is arranged on an end side of the traction sheave.

7. The drive shaft of claim 1 wherein a second support shaft-side circumferential stop is arranged on a connecting piece which is of separate configuration from the support shaft.

8. The drive shaft of claim 1 wherein a first support shaft-side circumferential stop is arranged on a radial support shaft projection of the support shaft.

9. The drive shaft of claim 1 wherein the inner guide face has exclusively circular cross sections over its axial length, and/or the outer guide face has exclusively circular cross sections over its axial length.

10. The drive shaft of claim 1 wherein one or both of the inner guide face or the outer guide face is of cylindrical or conical configuration.

11. The drive shaft of claim 1 wherein one or both of the inner guide face or the outer guide face is of completely cylindrical or completely conical configuration.

12. The drive shaft of claim 1 wherein the traction sheave-side circumferential stop is spaced apart from the drive axis, said spacing not less than 0.3 times or 0.5 times the diameter of the outer guide face of the support shaft, on which the traction sheave is guided axially in the region of the traction face.

13. An elevator system, comprising:
a drive shaft, comprising,
a support shaft having an outer guide face,
at least one support shaft-side circumferential stop, defined in or extending from an axially-directed face of said support shaft, that is configured to impart a circumferentially directed drive force during axial rotational movement of said support shaft,
a traction sheave having an inner guide face, and a traction face configured to drive a traction mechanism of the elevator system, said traction sheave being concentrically disposed on said support shaft about a central axis such that said inner guide face of said traction sheave is positioned against said outer guide face of said support shaft, and at least one traction sheave-side circumferential stop extending from or defined in an axially-directed face of said traction sheave in an axial direction of the central axis, and disposed in a complimentary positive locking engagement with said at least one support shaft-side circumferential stop, such that a circumferentially-directed side face of said at least one traction sheave-side circumferential stop constantly abuts a complimentary circumferentially-directed side face of said at least one support shaft-side circumferential stop, so as to enable said support shaft to transmit a drive torque from said support shaft to said traction sheave via said abutting side faces of said circumferential stops, wherein a ratio W/L of a wall thickness W of said traction sheave and an axial length L of said traction face is at most 0.5.

14. The elevator system of claim 13, further comprising a support, the support having a radial support diameter, the traction face having a traction face diameter, a ratio of the traction face diameter and the radial support diameter being at most 40.

* * * * *